US006349262B1

(12) United States Patent
Lewiner et al.

(10) Patent No.: US 6,349,262 B1
(45) Date of Patent: Feb. 19, 2002

(54) TRAFFIC INFORMATION DEVICE

(76) Inventors: Jacques Lewiner, 7, avenue de Suresnes, 92210 Saint-Cloud; Eric Carreel, 9, rue du Général Gouraud, 92190 Meudon, both of (FR)

( * ) Notice: Subject to any disclaimer, the term of this patent is extended or adjusted under 35 U.S.C. 154(b) by 0 days.

(21) Appl. No.: 09/381,008

(22) PCT Filed: Mar. 11, 1998

(86) PCT No.: PCT/FR98/00494

§ 371 Date: Jan. 7, 2000

§ 102(e) Date: Jan. 7, 2000

(87) PCT Pub. No.: WO98/41961

PCT Pub. Date: Sep. 24, 1998

(30) Foreign Application Priority Data

Mar. 14, 1997 (FR) ..... 97 03111

(51) Int. Cl.[7] ..... G08G 1/0967

(52) U.S. Cl. ..... 701/210; 701/209; 701/208; 701/201; 701/202; 701/204

(58) Field of Search ..... 701/206, 210, 701/211, 213, 25, 26, 204, 209, 201, 202

(56) References Cited

U.S. PATENT DOCUMENTS 5,862,509 A * 6/1999 Desai et al. ..... 701/209
5,911,773 A * 6/1999 Mutsuga et al. ..... 701/210
5,948,042 A * 9/1999 Heimann et al. ..... 701/210
6,195,611 B1 * 2/2000 Sakamoto et al. ..... 701/210

FOREIGN PATENT DOCUMENTS

| | | |
|---|---|---|
| EP | 0 760 507 A1 | 3/1997 |
| FR | 2 726 382 | 5/1996 |
| JP | WO96/17315 | 6/1996 |

OTHER PUBLICATIONS

French Preliminary Search Report dated Dec. 5, 1997, Appl. No. FR 9703111.
International Search Report dated Jul. 31, 1998, Appl. No. PCT/FR 98/00494.

* cited by examiner

*Primary Examiner*—Richard M. Camby
(74) *Attorney, Agent, or Firm*—Marshall, Gerstein, & Borun

(57) ABSTRACT

The invention concerns a traffic information device comprising a portable one-way messaging receiver (10), designed to provide motorists with information concerning running times in a road network, said receiver comprising a keyboard (12) receiver memory contains, for each road network section, a starting point, an arrival point and an elementary running time. Moreover, the central unit is adapted to update the elementary running times of the sections on the basis of received radio messages, and to compute and display the global running time between a starting point and an arrival point as required, based on the stored elementary running times.

14 Claims, 2 Drawing Sheets

TRAFFIC INFORMATION DEVICE

Figure 1:
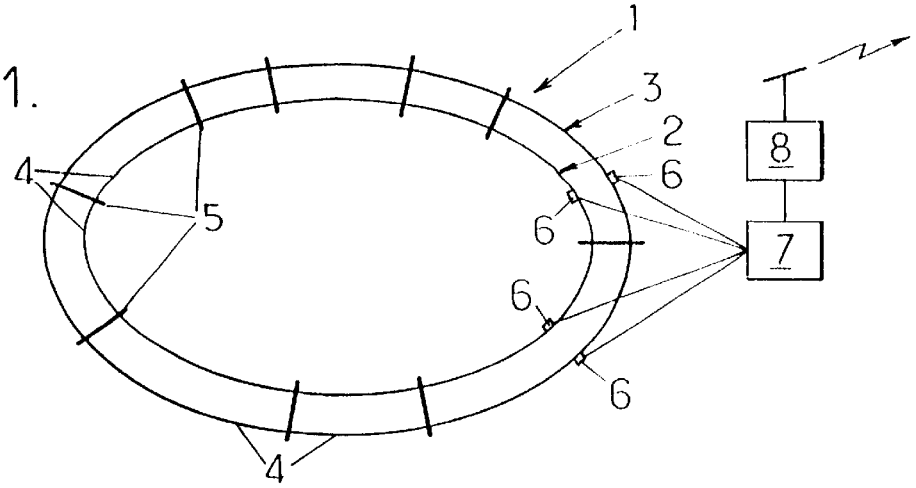

The invention relates to traffic information devices.

The known traffic information devices can be split into two main categories:

those essentially designed to give motorists routing information, these systems generally being fitted on board the vehicles and, as applicable, capable of receiving qualitative information relating to the weather forecast, the existence of works on certain sections of the road network and congestion in the road network, and those designed to provide information relating to journey times in a predetermined road network.

It is to this latter category that the traffic information device proposed by the invention belongs.

The known devices of this type come in the form of stationary illuminated display panels, which display an estimated journey time between the point at which they are located on the one hand and one or more other predetermined points of the road network on the other.

However, these information devices have the following disadvantages:

they can not be consulted by a motorist until he is already on the road network in question or in its immediate vicinity, which means that it is generally too late for the motorist to abandon his journey or easily change his itinerary if traffic on the relevant road network proves difficult: more generally, these existing devices are designed to give users immediate, up-to-date information about the relevant road network but they do not enable motorists to plan their journey in advance taking advantage of the best routes, and these display panels provide only incomplete information to motorists who are not going to predetermined destinations for which a journey time is displayed.

Documents FR-A-2 726 382 and WO-A-96 17315 also describe on-board "navigation" systems for vehicles but these systems are complex and expensive and do not provide the user with information about the actual journey times.

The specific objective of the present invention is to alleviate these disadvantages.

To this end, the invention proposes a traffic information device, designed to provide information relating to journey times in a predetermined road network, which is sub-divided into a plurality of sections linked one to the other, characterised in that it comprises a portable radio-messaging receiver having:

receiving means for receiving radio messages, at least one memory for storing the messages received, an electronic central unit for processing these messages, a control interface enabling a user to control the central unit, and a screen for displaying the information resulting from at least some of the messages received, depending on instructions entered by the user via the control interface, and in that the receiver memory contains:

topological data specific to the road network in question, this data including at least an identification code for a point of departure and a point of destination for each section of the road network, as well as digital data representative of journey times on the sections of the road network, referred to as basic journey times and in that the central unit of the receiver is set up to:

detect certain predetermined radio messages containing at least digital information representative of the updated basic journey times, update said stored digital data representative of the basic journey times depending on the digital data received, and, depending on a desired departure point and destination point set in said central unit by the user through the control interface, to:

determine which sections of the road network should be used between this desired starting point and this desired destination point, compute an overall journey time equal to the sum of the basic journey times on said sections to be used between the desired departure point and the desired destination point, and display at least this overall journey time on the screen.

As a result of these provisions, motorists can plan and optimise their journeys, having a precise idea of their journey time in advance.

In preferred embodiments of the invention, there is also the option of using in addition one and/or another of the following functions:

the stored digital data and the digital information received include a basic journey time for each section of the relevant road network;

at least the digital information received includes a traffic speed on each section of the relevant road network, the memory of the receiver also incorporating the length of each section of the road network;

the device is designed to be used within a road network in which several routes may be used between at least certain starting points and certain destination points, the central unit of the receiver being set up, depending on the desired starting point and destination point, to:

determine the different possible routes between the desired starting point and destination point and determine for each of these routes the sections of the road network which will be used between the desired starting point and destination point, compute an overall journey time for each possible route across all said sections between the desired starting point and destination point, determine which is the best route of all said possible routes, for which the overall journey time will be the shortest, and display at least this optimum route and the corresponding journey time on the screen;

the central unit is set up to display on the screen several possible routes between the desired starting point and destination point as well as the overall journey times corresponding to these possible routes;

the central unit is set up to display on the screen a diagram representative of at least one part of the relevant road network, this diagram showing the different sections of said part of the road network by lines whose visual attributes correspond to the flow rates of traffic on said sections;

the central unit is set up to display on the screen a schematic map of at least a part of the relevant road network, this map showing two symbols corresponding respectively to the locations of the desired points of departure and destination;

the memory of the receiver contains at least one predetermined route, identified by its point of departure and its point of destination, the central unit being set up to:

allow the user to select this predetermined journey directly without having to select the starting point and destination point in succession, and display the overall journey time corresponding to this predetermined journey;

the central unit is set up to detect certain predetermined radio messages carrying new information relating to the topology of the road network and to update the topological data contained in the memory of the receiver on the basis of these messages;

the device consists of a casing of a weight of less than 100 grams, in which the control interface is a simplified keypad having less than ten keys;

the device has indicating means to attract the attention of the user and the central unit is set up to:

store at least the last overall journey time TO looked up by the user, on the basis of digital data representative of the updated basic journey times received by radio, update this last overall journey time in cycles, thereby determining an updated overall journey time T, and activate the indicator means if the overall journey times T0 and T are at variance by a time ΔT greater than a certain limit, the receiver memory includes data indicating the time at which the basic journey times were last updated in said memory, the central unit being set up, when computing and displaying an overall journey time, to display a warning message if at least one of the basic journey times taken into account in this overall journey time has not been updated for a predetermined time preceding this computation point;

the receiver memory includes data relating to the accessibility of certain parts of the road network, the central unit being set up to:

detect certain predetermined radio messages containing information relating to said accessibility data and update the stored accessibility data on the basis of these messages, and, when it displays the overall journey time between a desired point of departure and point of destination, display in addition at least some of the accessibility data relating to the parts of the road network falling between the desired point of departure and point of destination;

the central unit is set up to determine an average traffic speed on each section of the road network and to display a warning message if the average traffic speed on at least one of the sections falling between the desired point of departure and point of destination is lower than a predetermined threshold value.

Other features and advantages of the invention will become clear from the description below of one embodiment, given by way of example and not restrictive in any respect, with reference to the appended drawings.

Figure 2:
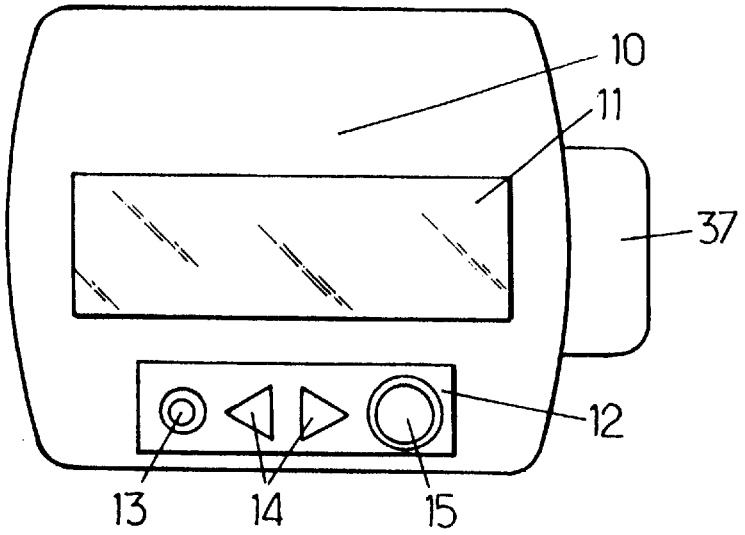
Figure 3:
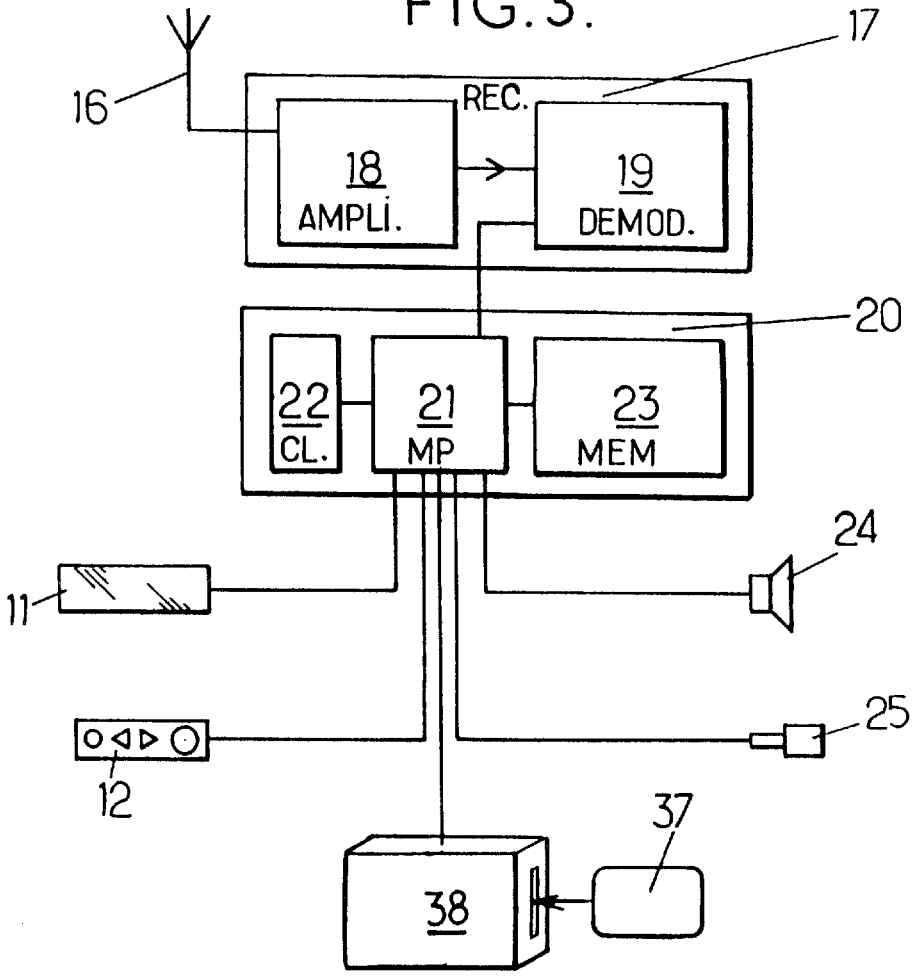

Of the drawings:

FIG. 1 is a schematic view of a road network in which a traffic information device proposed by the invention may be used, FIG. 2 is a schematic view of a one-way radio-messaging receiver forming one embodiment of the traffic information device proposed by the invention, FIG. 3 is a partial block diagram of the receiver of FIG. 2, and FIGS. 4 to 6 illustrate examples of displays which can be presented on the screen of the receiver of FIG. 2, it being pointed out that different displays with other aesthetic attributes could conceivably used to display the same information.

The same references are used to denote identical or similar features in the different drawings.

The present invention is intended to keep motorists informed about journey times within a road network which may be, for example, but is not necessarily a motorway urban ring road 1 such as that illustrated in FIG. 1.

This urban motorway may have two sets of traffic lanes 2, 3 for opposite directions of traffic, for example, which will be referred to respectively throughout this description as inner ring road and outer ring road.

The inner ring road 2 and the outer ring road 3 are each sub-divided into a plurality of sections 4 separated one from the other by entry/exit points 5 which, in this case, will be called "gateways" and which may be common to the inner 2 and outer 3 ring roads.

Each section 4 therefore has a starting point constituted by a gateway 5 and a destination point constituted by another gateway 5.

Sensors 6 are provided along the inner ring road 2 and the outer ring road 3, and preferably on at least each section 4, which in particular may be integrated in the carriageway or mounted on cross-beams above the carriageway and which measure the average speed of travel of the vehicles, for example.

Such sensors 6 are well known in the state of the art and, being widely used, will not be described here. The measurements taken by the sensors 6 are consolidated in a central computer station 7 by means of wire or radio links.

This central station 7 is linked to one or more fixed radio-messaging base stations or may itself be a fixed radio-messaging base station, transmitting predetermined radio messages containing digital information about the basic travel times of vehicles on each of the sections 4 of the road network 1.

The radio messages in question may be encoded, for example in accordance with the "ERMES" European standard (E.E.C. Directives 85/374 and 92/59) or with any other one-way radio-messaging or radio telephone protocol.

These radio messages are transmitted at regular periods of time by the fixed base station 8, for example every three minutes.

Accordingly, even in the situation where one of these update messages has not been correctly received by a radio-messaging receiver, this receiver will nevertheless have the advantage of reliable information as soon as it receives the next message correctly, transmitted three minutes later.

This avoids having to use a system whereby the receivers transmit acknowledgement messages, which on the one hand would be incompatible with one-way radio-messaging receivers and on the other would cause congestion of the Hertzian space, already very busy.

By preference, these predetermined radio messages are transmitted among other radio messages carrying either general information or personalised messages intended for subsequent consultation by their addressees on portable radio-messaging receivers.

The predetermined radio messages in question may include, for example:

an identification field enabling the portable radio-messaging receivers to detect that these are messages containing digital data relating to journey times on the road network, and a sequence of digital data representative of updated basic journey times on different sections 4 of the road network 1, these digital values consisting for example either of average traffic speeds on each of the relevant sections 4 or basic journey times on said sections 4 (computed at the central station 7 on the basis of speeds measured by the sensors 6 and the lengths of the sections 4, for example), identification for the sections 4 corresponding to the traffic speeds or the updated basic journey times thus transmitted, this identification being represented by a number, for example, or by points of departure and destination of each section, it also being possible, optionally, to omit this identification if each radio message contains information about all the sections 4 of the road network, always presented in the same order, and, as applicable, accessibility data relating to at least some sections 4 of the network and/or the gateways 5, this accessibility data indicating whether a section 4 or a gateway 5 may or may not be used by a motorist.

The radio messages carrying information about the journey times are received by the users on portable radio-messaging receivers 10 such as that illustrated in FIG. 2 or, as applicable, on mobile telephones with radio-messaging functions.

Each of these receivers comes in the form of an independent lightweight casing (weighing less than 100 g, for example) which is provided with an alpha-numeric screen 11 and a simplified keypad 12 having for example four keys, namely:

a key 13 providing access to special functions, two scroll keys 14 enabling a cursor to be moved around the screen 11 and/or being used to select specific areas of said screen, these areas being referred to as "icons" hereafter, and a validation key 15 enabling selections made on the screen using the keys 14 to be confirmed.

FIG. 3 shows a partial block diagram of the receiver 10, which conventionally comprises:

an antenna 16 for receiving radio messages transmitted by the fixed base station 8, a receiving device 17 (REC.) including in particular on the one hand an amplifier 18 (AMPLIF.) receiving the signals picked up by the antenna 16 and on the other a demodulator 19 (DEMOD.) receiving the signals amplified by the amplifier 18, a central unit 20 (CPU) which receives the demodulated signals from the output of the demodulator 19, this central unit 20 having a micro-controller or microprocessor 21 (MP) connected to a clock 22 (CL.) and at least one memory 23 (MEM) (optionally, the clock and the memory might not be incorporated in the central unit) the microprocessor 21 being linked to the screen 11, the keypad 12 and to indicator means designed to catch the attention of the user, for example an electronic bell 24 and/or a buzzer 25.

Furthermore, the microprocessor 21 may advantageously be connected to a card reader 38 designed to communicate with a portable memory card 37 (FIG. 2).

The card reader 38 may be used, for example, to operate the central unit 21 in conjunction with a programme enabling the radio messages relating to the journey times on the road network 1 to be manipulated (either by loading this programme into the central unit 21 or by allowing the central unit 21 to run this programme inside the card 37 itself), as explained in French patent application No. 97 02857 filed on Mar. 11, 1997.

In addition, the card reader 38 may also be used to authorise or not manipulation of the radio messages relating to journey times on the road network 1 depending on a validity datum (number of units representing a certain sum of money paid in advance or subscription expiry date), which is read from the card 37, as taught in French patent application No. 97 02856, for example, filed on Mar. 11, 1997.

The radio-messaging receiver 10 described above operates as follows.

When the fixed base station 8 transmits a message personally addressed to the user of the receiver 10, the microprocessor 21 detects in this message an identification number which is specific to the receiver 10 and it stores this message in the memory 23, simultaneously activating the bell 24 and/or the buzzer 25 so that the user is notified that a message has arrived for him.

This user can then look up the message on the screen 11 and, as applicable, delete it from the memory 23.

Furthermore, if the fixed base station 8 transmits a radio message containing information about journey times on the road network 1, the microprocessor 21 recognises this message from the identification field contained in said message or from an address contained in this message and common to all the receivers 10 authorised to manipulate radio messages relating to journey times on the road network 1.

Accordingly, the microprocessor does not activate either the bell 24 or the buzzer 25 but instead simply stores the information duly received in a part of the memory 23 dedicated to traffic information.

This part of the memory 23 contains for example:

topological data relating to the road network 1, this topological data incorporating for example identification of the points of departure and points of destination of each section 4 of the road network as well as the length of said sections, accessibility data indicating whether the sections 4 and the gateways 5 are accessible to motorists or not, and digital data relating to basic journey times on the different sections 4 of the road network, this digital data possibly incorporating, for example, an average traffic speed on each section 4 or simply an average journey time across each of said sections.

The digital data relating to travel times and the accessibility data are therefore updated in the memory 23 on a regular basis.

Furthermore, the topological data on the road network 1 may also be updated from time to time, if the sections 4 of the road network are newly created or if such sections 4 have recently been integrated in the traffic information system.

This topological data can be updated by means of radio messages or optionally by reading a memory card 37 if the receiver 10 is provided with a memory card reader 38 or by any other means.

Figure 4:
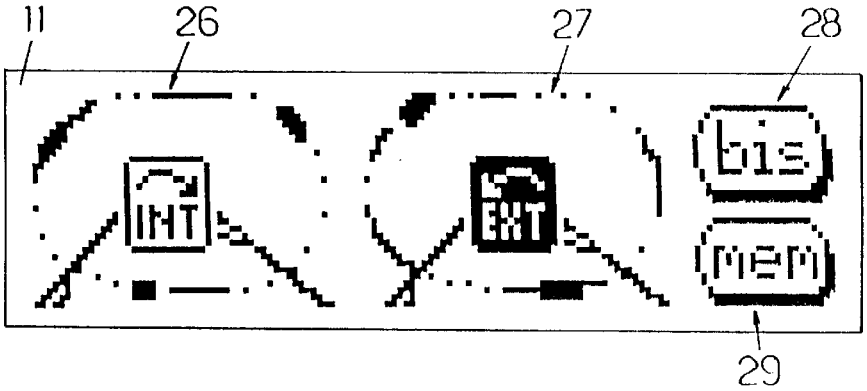

If the user of the receiver 10 wants to find out Information about a journey time on the road network 1, he starts by selecting and confirming a corresponding option in the general menu displayed on the screen 11 when the receiver 10 is switched on, which brings up on the screen 11 the display illustrated in FIG. 4.

This display comprises four areas of the screen or "icons" which can be selected using the keys 14, namely:

an icon 26 representing a schematic map of the inner ring road 2, the different sections 4 of this inner ring road being represented by broken lines, the visual attributes of which correspond to average traffic speeds which are stored in the memory 23 or are computed by the microprocessor 21 on the basis of the basic journey times and section lengths stored in said memory 23 (the zones where traffic is flowing freely, i.e. where the average traffic speed is in excess of 60 km/h, for example, are shown by dots; the slower zones, i.e. where the average traffic speed is between 40 and 60 km/h, for example, are represented by solid lines; and the zones where there are backlogs, i.e. where the average traffic speed is less than 40 km/h, for example, are represented by thicker lines), a second icon 27, which represents a schematic map of the outer ring road 3 with the same symbols as for icon 26, an icon 28 with a label "more", and an icon 29 with a label "mem.".

From the screen illustrated in FIG. 4, the user selects the desired icon using the keys 14, which will then highlight said icon in a different manner from the other icons (in the example illustrated in FIG. 4, icon 27 has been selected), and confirms his choice with key 15.

Figure 5:
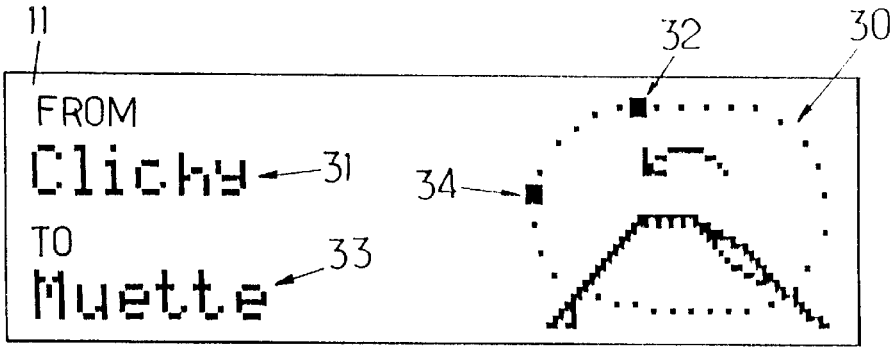

Assuming that the user selected and confirmed icon 27 corresponding to the outer ring road 3, the central unit 20 will then present on the screen 11 a display such as that illustrated in FIG. 5, initially without the text zones indicating "TO" and "Muette" in said FIG. 5.

A schematic map 30 of the outer ring road 3 will then reappear on this screen, in this instance with no differentiation between the traffic zones which are flowing freely and the traffic zones flowing less freely.

Furthermore, two text fields will also appear on the screen 11, namely:

a first text field showing the word "FROM" indicating the starting point of the journey desired by the user of the box 10, and a second text field 31 in which a name or possibly an identification number for one of the gateways 5 of the outer ring road 3 (in this case "Clichy") appears.

The user can then scroll through different names of gateways (5) in succession in the text field 31 using the keys 14 until the gateway 5 corresponding to his desired departure point appears.

A square 32 simultaneously appears on the schematic map 30 which provides a schematic indication of the position of gateway 5 corresponding to the point of departure on the outer ring road 3.

The user then confirms the choice of his point of departure using the validation key 15, after which a new text field 33 will appear on the screen also displaying the name of a gateway 5, in this case "Muette", underneath another text field containing the wording "TO" to indicate that the second gateway name corresponds to the point of destination desired by the user of the box 10.

The user then selects the gateway 5 corresponding to a desired point of destination using the keys 14, which causes a second square 34 to appear on the schematic map 30, corresponding to the approximate position of said point of destination, after which the user validates his choice using the key 15.

Figure 6:
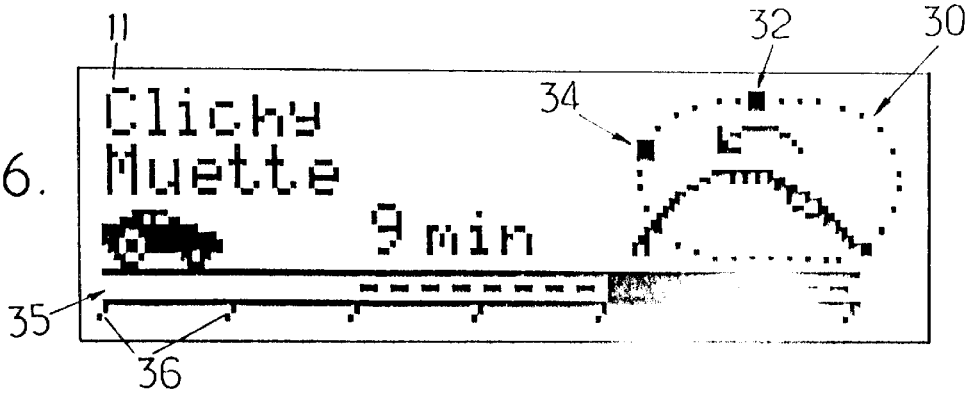

The microprocessor 21 then brings up on the screen 11 the display illustrated in FIG. 6, which indicates the gateways 5 corresponding respectively to the desired point of departure and point of destination and the estimated journey time between these points of departure and destination, in this case 9 minutes.

This estimated journey time is computed by the microprocessor 21 as being the sum of the basic journey times on the different sections 4 making up the journey between the desired points of departure and destination.

These basic journey times are either stored directly in the memory 23 and updated immediately by the radio messages received or computed by the central unit 21:

on the basis of average traffic speeds stored in the memory 23 for each section 4 and updated by the radio messages received, and on the basis of the lengths of sections stored in said memory 23.

Furthermore, the display illustrated in FIG. 6 may advantageously also call up the schematic map 30 of the outer ring road 3 with the squares 32 and 34 locating the points of departure and destination.

By preference, the display illustrated in FIG. 6 also gives a visual presentation of the route to be taken between the points of departure and arrival.

In this instance, this visual presentation consists of a band 35 between two horizontal lines, this band 35 being marked with symbols 36 representing the different gateways 5 between the point of departure and the point of destination, said band 35 being different in appearance depending on the traffic flow rates of the sections 4 of the road network located between the gateways corresponding to the symbols 36.

For example, the sections on which the average traffic speed is greater than 60 km/h are shown in white, the sections on which the traffic speed is between 40 and 60 km/h are shown by broken lines and the sections on which the traffic speed is less than 40 km/h are shown in black.

Furthermore, the display illustrated in FIG. 6 may optionally include in addition information relating to the accessibility of the sections 4 and the gateways 5 between the desired point of departure and point of destination.

For example, the sections 4 or the gateways 5 which are closed to the pubic can be marked with a symbol in the form of an "X".

Furthermore, if the average traffic speed on at least one section 4 of the road network located between the desired point of departure and point of destination is less than a predetermined threshold value (for example 10 km/h), the microprocessor 21 will display a warning message on the screen 11 indicating "traffic congestion" instead of the estimated journey time.

Finally, the display illustrated in FIG. 6 may optionally also bring up a message such as "?" or "data invalid" if the digital data used to compute the journey time is too old.

To this end, the memory 23 may incorporate, for each section 4 of the road network, the date and time at which the basic journey time and/or the average traffic speed on this section was last updated.

When it computes the overall journey time between the desired point of departure and point of arrival, the microprocessor 21 verifies that the updates of the different sections 4 between this point of departure and this point of destination are not too old.

For example, the microprocessor 21 will display the above-mentioned warning message "data invalid" or "?" if the data relating to one of the sections 4 between the desired point of departure and point of destination have not been updated for more than half an hour.

Optionally, the memory 23 could incorporate only a date and time at which all the sections 4 were updated if the digital data relating to all the sections 4 is updated simultaneously with each radio message received.

Moreover, the microprocessor 21 is advantageously designed to update the last estimated journey time T0 looked up by the user in cycles, for example for a period of 15 mn following the last consultation by the user.

In this manner, the microprocessor 21 compares the initially estimated journey time T0 corresponding to the last consultation by the user with the same, updated journey time T and said microprocessor activates the bell 24 and/or the buzzer 25 if the difference ΔT between these two times becomes greater than a predetermined value, it being possible for this predetermined value to be an absolute value (for example 5 mn) or a relative value (for example 20% of T0).

Accordingly, the user is warned that he must look up his journey time on the portable box 10 again in order to obtain an exact estimate of this journey time.

Furthermore, turning back to FIG. 4, the device 10 can be operated in a manner similar to that described above if the user selects and validates the icon 26 corresponding to the inner ring road 2.

Moreover, if the user selects and confirms the icon 28 (more), the microprocessor 21 will immediately bring up a display such as that illustrated in FIG. 6, indicating the updated journey time corresponding to the last consultation by the user.

Finally, by selecting and validating the icon 29, "mem", the user can bring up on the screen 11 a journey previously stored as well as the corresponding estimated journey time.

If several journeys have been stored in memory, simply depressing the validation key 15 successively will make it possible to move from one stored journey to another.

A specific journey can initially be stored in memory by displaying the display screen illustrated in FIG. 6, for example, and then depressing the special functions key 13, which will bring up a memory programming menu.

Finally, in accordance with one possible embodiment of the invention, instead of making the user initially choose between the icons 26 and 27 corresponding respectively to the inner and outer ring roads 2, 3, it would also be possible to make provision so that the central unit 21 computes the respective journey times between the desired points of departure and destination on the one hand via the inner ring road 2 and on the other via the outer ring road 3, in which case both of the estimated journey times would be displayed on the screen 11 for the user.

In another embodiment, the microprocessor 21 could calculate the two journey times corresponding to the two possible routes between the desired points of departure and destination, via the inner ring road 2 and the outer ring road 3 respectively, but said central unit would display only the minimum journey time indicating whether this minimum journey time corresponded to the inner ring road 2 or the outer ring road 3.

What is claimed is:

1. A traffic information device, designed to provide information relating to journey times within a predetermined road network, which is sub-divided into a plurality of sections linked one to the other, wherein it comprises a portable radio-messaging receiver having:

receiving means for receiving radio messages, at least one memory for storing the messages received, an electronic central unit for processing these messages, a control interface enabling a user to control the central unit, and a screen for displaying the information resulting from at least some of the messages received, depending on instructions entered by the user via the control interface, wherein the receiver memory contains:

topological data specific to the road network in question, this data including at least an identification code for a point of departure and a point of destination for each section of the road network, as well as digital data representative of journey times on the sections of the road network, referred to as basic journey times, wherein the central unit of the receiver is set up to:

detect certain predetermined radio messages containing at least digital information representative of the updated basic journey times, update said stored digital data representative of the basic journey times depending on the digital data received, and, depending on a desired departure point and destination point set in said central unit by the user through the control interface, to:

determine which sections of the road network should be used between these desired starting and this destination points, compute an overall journey time equal to the sum of the basic journey times on said sections to be used between the desired departure and destination points, and display at least this overall journey time on the screen.

2. A device according to claim 1, wherein the stored digital data and the digital information received include a basic journey time for each section of the relevant road network.

3. A device according to claim 1, wherein at least the digital information received includes a traffic speed on each section of the relevant road network, the receiver memory also incorporating the length of each section of the road network.

4. A device according to claim 1, designed to be used within a road network in which several routes may be used between at least certain starting points and certain destination points, the central unit of the receiver being set up, depending on the desired starting and destination points, to:

determine the different possible routes between the desired starting point and destination point and determine for each of these routes the sections of the road network which will be used between the desired starting point and destination point, compute an overall journey time for each possible route across all said sections between the desired starting point and destination point, determine which is the best route of all said possible routes, for which the overall journey time will be the shortest, and display at least this optimum route and the corresponding journey time on the screen.

5. A device according to claim 4, wherein the central unit is set up to display on the screen several possible routes between the desired starting point and destination point as well as the overall journey times corresponding to these possible routes.

6. A device according to claim 1 wherein the central unit is set up to display on the screen a diagram representative of at least one part of the relevant road network, this diagram showing the different sections of said part of the road network by lines whose visual attributes correspond to the flow rates of traffic on said sections.

7. A device according to claim 1, wherein the central unit is set up to display on the screen a schematic map of at least a part of the relevant road network, this map showing two symbols corresponding respectively to the locations of the desired points of departure and destination.

8. A device according to claim 1, wherein the memory of said receiver contains at least one predetermined route, identified by its point of departure and its point of destination, the central unit being set up to:

allow the user to select this predetermined journey directly without having to select the starting point and destination point in succession, and display the overall journey time corresponding to this predetermined journey.

9. A device according to claim 1, wherein the central unit is set up to detect certain predetermined radio messages carrying new information relating to the topology of the road network and to update the topological data contained in the memory of the receiver on the basis of these messages.

10. A device according to claim 1, consisting of a casing of a weight of less than 100 grams, in which the control interface is a simplified keypad having less than ten keys.

11. A device according to claim 1, comprising indicating means to attract the attention of the user and wherein the central unit is set up to:

store at least the last overall journey time T0 looked up by the user, on the basis of digital data representative of the updated basic journey times received by radio, update this last overall journey time in cycles, thereby determining an updated overall journey time T, and activate the indicator means if the overall journey times T0 and T are at variance by a time $\Delta T$ greater than a certain limit.

12. A device according to claim 1, wherein the memory of the receiver includes data indicating the time at which the basic journey times were last updated in said memory, the central unit being set up, when computing and displaying an overall journey time, to display a warning message if at least one of the basic journey times taken into account in this overall journey time has not been updated for a predetermined time preceding this computation point.

13. A device according to claim 1, wherein the memory of the receiver includes data relating to the accessibility of certain parts of the road network, the central unit being set up to:

detect certain predetermined radio messages containing information relating to said accessibility data and update the stored accessibility data on the basis of these messages, and, when it displays the overall journey time between a desired point of departure and point of destination, display in addition at least some of the accessibility data relating to the parts of the road network falling between the desired point of departure and point of destination.

14. A device according to claim 1, wherein the central unit is set up to determine an average traffic speed on each section of the road network and to display a warning message if the average traffic speed on at least one of the sections falling between the desired point of departure and point of destination is lower than a predetermined threshold value.

* * * * *